US007179062B1

(12) United States Patent
Drevitson et al.

(10) Patent No.: US 7,179,062 B1
(45) Date of Patent: Feb. 20, 2007

(54) INTEGRATED SHOP VACUUM AND AIR COMPRESSOR SYSTEM

(76) Inventors: Kyle C. Drevitson, 45 Hilltop Trail, Sparta, NJ (US) 07871; Patrick F. Carella, 14 Heather La., Morristown, NJ (US) 07960; Richard L. Carella, 21 Bard Dr., Monroe Township, NJ (US) 07831; Mark A. Clemente, 366 Ridgewood Ave., Glen Ridge, NJ (US) 07028; Richard D. Johnson, 22 Ski Hill Dr., Bedminster, NJ (US) 07921

( * ) Notice: Subject to any disclaimer, the term of this patent is extended or adjusted under 35 U.S.C. 154(b) by 0 days.

(21) Appl. No.: 11/255,397

(22) Filed: Oct. 21, 2005

(51) Int. Cl.
*F04B 53/00* (2006.01)

(52) U.S. Cl. ..... 417/234; 15/345

(58) Field of Classification Search ..... 417/234; 15/328, 330, 345
See application file for complete search history.

(56) References Cited

U.S. PATENT DOCUMENTS

| | | | | | |
|---|---|---|---|---|---|
| 2,327,553 | A * | 8/1943 | Ponselle | 55/438 |
| 2,810,991 | A * | 10/1957 | Mead et al. | 451/88 |
| 3,931,662 | A * | 1/1976 | Nayfa et al. | 15/320 |
| 4,233,707 | A * | 11/1980 | Leblanc | 15/311 |
| 4,300,261 | A * | 11/1981 | Woodward et al. | 15/345 |
| 4,739,535 | A * | 4/1988 | Schuld et al. | 15/315 |
| 4,829,625 | A * | 5/1989 | Wang | 15/422.2 |
| 5,134,748 | A * | 8/1992 | Lynn | 15/321 |
| 5,208,940 | A * | 5/1993 | London et al. | 15/345 |
| 5,485,651 | A * | 1/1996 | Payeur | 15/321 |
| 5,560,075 | A * | 10/1996 | Jankowski | 15/327.6 |
| 5,606,769 | A * | 3/1997 | Tomasiak et al. | 15/327.6 |
| 5,797,197 | A * | 8/1998 | Alday | 34/618 |
| 5,813,086 | A * | 9/1998 | Ueno et al. | 15/320 |
| 6,170,118 | B1 * | 1/2001 | McIntyre et al. | 15/327.6 |
| 6,175,988 | B1 * | 1/2001 | White et al. | 15/327.1 |
| 6,344,782 | B1 * | 2/2002 | Yang | 335/205 |
| 6,385,809 | B1 * | 5/2002 | Martin et al. | 15/326 |
| 6,530,116 | B2 * | 3/2003 | Berfield et al. | 15/328 |
| 6,647,584 | B2 * | 11/2003 | Pileggi | 15/321 |
| 7,047,593 | B2 * | 5/2006 | Kitamura et al. | 15/353 |
| 2004/0098825 | A1 * | 5/2004 | Swift et al. | 15/345 |

* cited by examiner

*Primary Examiner*—William H. Rodriguez
(74) *Attorney, Agent, or Firm*—Ernest D. Buff-Associates, LLC; Ernest D. Buff; Dave Narasimhan

(57) ABSTRACT

An integrated, yet divisible shop vacuum and air compressor system is provided with a blower, a wet and dry vacuuming section and a compressor section, each of which is mounted on a easy to relocate trolley. The vacuum system has a separate motor from the compressor and is independently operable with full capacity. A filter in front of the vacuum suction prevents debris and moisture from entering the vacuum-generating unit. The vacuum hose decreases in diameter as a function of distance from the unit to increase airflow velocity. Air pressure within a compressed air storage tank in the compressor section is sensed and controlled. The integrated shop vacuum and air compressor system provides dry vacuuming, wet vacuuming, high pressure air delivery and air blowing capability from a single, mobile unit. The unit is fully integrated into a single, yet divisible platform which may come with or have available via after market purchase, a second set of wheels for total independence.

12 Claims, 2 Drawing Sheets

INTEGRATED SHOP VACUUM AND AIR COMPRESSOR SYSTEM

BACKGROUND OF THE INVENTION

1. Field of the Invention

This invention relates to vacuum systems; and, more particularly to a shop vacuum and air compressor system that is integrated into a single unit, divisible unit and provides a plurality of functionalities, including air compressor, dry vacuum, wet vacuum, and blower functions, suitable for a wide variety of applications.

2. Description of the Prior Art

Many patents address issues related to proving vacuum cleaning functionality and compressor functionality as separate devices. Moreover, many of the vacuum cleaners do not provide effective dry and wet vacuum functionality. The compressor devices only provide very limited application scope.

U.S. Pat. No. 2,327,553 to R. A. Ponselle discloses a vacuum cleaner having an internal bag constructed so that it is appointed to house both wet and dry materials removed from a surface. This vacuum cleaner does not comprise a unit having an air compressor, wet vacuum, dry vacuum, and blower in a single housing.

U.S. Pat. No. 2,810,991 to W. H. Mead, et al. discloses an abrasive blasting apparatus having particular applications in treating surfaces by continuously impelling an abrasive against a surface, removing the abrasive and waste material, and reusing the abrasive. This abrasive blasting apparatus does not include compressor capabilities, but is merely an abrasive blasting apparatus. The abrasive grit is forced onto the surface by air for polishing or cleaning a surface. The abrasive blasting apparatus does not comprise a unit having an air compressor, wet vacuum, dry vacuum, and blower in a single housing.

U.S. Pat. No. 3,931,662 to Nayfa, et al. discloses a self-propelled floor-cleaning machine for scrubbing or shampooing rugs or carpeted floor surfaces, or for waxing, polishing, or scrubbing hard floor surfaces. The machine includes a vacuum pickup system having a collection tank and an electric motor-vacuum pump unit. Air for pressurizing the supply tank and for aerating and foaming the solution within the tank is provided from an air compressor-electric motor unit. In operation, the solution in the tank is agitated by the motor-pump unit and aerated by the compressor unit to produce foam, which is caused to flow from the main tank chamber into the trough as a result of the pressurizing of the tank. The compressor unit does not provide compressed air that can be utilized as a forced air stream by the user, but rather merely provides aeration for the generation of foam internally within the tank. Therefore, the abrasive blasting apparatus disclosed by the '662 patent does not suggest a unit having an air compressor, wet vacuum, dry vacuum, and blower in a single unit, but merely is a floor cleaning machine having wet/dry vacuum capabilities.

U.S. Pat. No. 4,233,707 to Leblanc discloses a footwear cleaning apparatus utilizing a combination of brushing and recirculation of compressed air. Footwear is placed on top of the footwear cleaning apparatus. Cleaning is accomplished by brushing the lower sides of the shoes and by passing compressed air over the upper sides of the shoes. The direction of the air and the brushing is oriented to direct any debris dislodged from the shoes toward a collection area in the central portion of the apparatus. The dislodged debris is then directed into the apparatus by a recirculation of the compressed air. The footwear cleaning apparatus comprises brush means, air compressor means, storage tank means, and a filter element. The footwear cleaning apparatus does not integrate air compressor, wet vacuum, dry vacuum, and blower functionalities into a single unit, but merely provides a footwear cleaning apparatus having localized compressed air directed through a pair of tubes and localized dry vacuum capabilities.

U.S. Pat. No. 4,300,261 to Woodward, et al. discloses a vacuum cleaning apparatus having air compressor means. The vacuum cleaning apparatus disclosed by the '261 patent provides an attachable hood adapted for attachment to a traditional vacuum cleaner. The vacuum cleaning apparatus disclosure is not an air compressor, wet vacuum, dry vacuum, and blower in a single unit, but merely is an attachment to a standard canister vacuum having a dry vacuum, rotating brush, and a miniature air compressor providing a jet of air adjacent to the brushing unit and suction unit of the device. The '261 patent's cleaning apparatus is not an independent, single unit, but represents, instead, an attachment unit appointed for utilization with a traditional vacuum cleaner, which provides the suction vacuum. Due to the absence of suction capabilities, this vacuum cleaning attachment cannot be utilized as a wet vacuum, or as a dry vacuum in its independent form. The miniature air compressor provides a jet stream delivered to the surface by way of a plurality of orifices. There is no provision for an external air hose so that the consumer can utilize the compressed air in a controlled manner for tasks other than cleaning floor surfaces.

U.S. Pat. No. 4,723,971 to Caldas discloses an industrial vacuum cleaner. The industrial vacuum cleaner comprises a structure in the form of a trolley with a platform on wheels. On the platform a base is placed to support an electric motor connected to a radial compressor or vacuum pump. The industrial vacuum cleaner is fitted with one or more radial compressors or vacuum pumps connected to the drum to provide greater suction power. When the switch of the industrial vacuum cleaner is pressed, the radial compressor or vacuum pump starts up. Dirt or other particulate material is suctioned through the device. The particulate material enters the drum and settles at the bottom, while the suctioned air leaves through a set of filters, and enters the atmosphere. Hence, the radial compressor is used to provide suction, not compressed air. The industrial vacuum cleaner disclosed by this patent does not include an air compressor, wet vacuum, dry vacuum, and blower in a single housing, but is merely an industrial vacuum cleaner unit.

U.S. Pat. No. 4,739,535 to Schuld, et al. discloses a vacuum cleaning machine having specific applications in cleaning fireplaces and the like. The vacuum cleaning machine comprises a cylindrical container shell with a closed bottom wall and an open upper mouth defining an upper vacuum chamber within the housing. A suction unit is mounted within the housing and comprises an electric motor, a blower with an inlet positioned within the vacuum chamber. The outlet of the blower discharges air into a lower chamber open to atmosphere and is not a compressed air output. The inlet of the blower is provided with a filter bag to trap dust particles. There is no indication that the vacuum cleaning machine can be utilized for both wet and dry vacuum functions; wet vacuuming would destroy the filter. Moreover, the vacuum cleaning machine does not include an air compressor function. Significantly, the vacuum cleaning machine is designed for removal of dry debris from a fireplace. It does not have an air compressor, wet vacuum, dry vacuum, and blower capability integrated within a single housing.

U.S. Pat. No. 4,829,625 to Wang discloses a portable vacuum cleaner/air compressor having a light. This cylindrical vacuum cleaner has a central impeller providing vacuum suction. The exhaust of the impeller is provided as a low pressure air delivery. The impeller is driven by a motor, the shaft of which is also connected to an air compressor through a gear attachment. The output of the compressor provides high pressure air delivery. Significantly, the air compressor runs at all times when the vacuum cleaner is used; and is driven by a single motor. Accordingly, the power available for vacuum cleaning and generation of high pressure air is limited, and both functions are compromised. The portable vacuum cleaner/air compressor cannot provide the functionality of a wet vacuum.

U.S. Pat. No. 5,134,748 to Lynn discloses a surface cleaning device generally comprising a scrubber head, a cleaning element, a supply of cleaning fluid, and means for removing the cleaning fluid. The scrubber head is provided with pressurized cleaning fluid and the debris, together with cleaning fluid, is sucked by vacuum into a separation container. The cleaning device does not provide a vacuum for cleaning or air pressure for use. The cleaning fluid is delivered to the scrubber head. At best this is a wet vacuum device. It may, alternatively, function as a dry vacuum device, in which case the cleaning fluid is shut off. Since the filter in the scrubbing head clogs readily, the surface cleaning device disclosed by the '748 patent functions as an ineffective dry vacuum cleaner.

U.S. Pat. No. 5,208,940 to London, et al. discloses a floor dryer and warning device for removing liquid and small particulate matter from various surfaces. A cylindrical floor surface drying device has a cylindrical container with a lid that contains a vacuum chamber and a air venting chamber. The vacuum is created by a motor driven impeller. Water is sucked by a vacuum hose and separated from the air, which is vented through the venting chamber. The venting chamber has a second motor and a rotating fan that dries the floor by passing outgoing air through a number of louvers. This device is at best a wet vacuum. It cannot function as a dry vacuum. There is no provision for delivering compressed air.

U.S. Pat. No. 5,485,651 to Payeur discloses a vacuum cleaning system utilizing a small-mouthed nozzle on a vacuum hose member having an air outlet member disposed therein. A high-pressure air stream is directed out of the nozzle onto the surface to be cleaned while vacuuming proceeds. This is a canister vacuum cleaner with a vacuum hose. The vacuum hose also carries a separate air pressure hose that is connected to a compressed air source such as a compressed air tank. Significantly, the air compressor tank is not integrated into the vacuum cleaning unit, but is located externally from the vacuum cleaning system. As a result, the vacuum cleaning system necessitates a separate air compressor tank, resulting in a bulky, cumbersome arrangement.

U.S. Pat. No. 5,560,075 to Jankowski discloses a wet or dry vacuum with low center of gravity. This wet or dry vacuum is made of polymeric material providing a low center of gravity. A motor drives a blower fan, and the suction side of the impeller is connected to a filter so as to draw clean air. Any debris or water sucked by the vacuum hose is removed from the air stream by the filter. This wet or dry vacuum does not provide compressed air, but is merely a wet/dry vacuum cleaner unit and is appointed for removal of wet/dry debris from a surface.

U.S. Pat. No. 5,606,769 to Tomasiak, et al. discloses a wet/dry utility vacuum cleaner having a detachable blower. The detachable blower is received within complementary shaped cavities or openings on the lid of the wet/dry vacuum cleaner. The detachable blower is also capable of being separated from the lid 7 for independent use, as desired. The wet/dry vacuum cleaner with detachable blower does not include air compressor capabilities, but is merely a wet/dry vacuum cleaner unit with a blower.

U.S. Pat. No. 5,797,197 to Alday discloses a mobile carpet dryer having a vacuum unit and blower unit that forces heated air onto the carpet. The mobile carpet dryer includes a blower unit that forces heated air onto the carpet, and a vacuum unit having a motor vacuums the carpet. Air is heated by a burner mounted on a burner stand, and is supplied with fuel from a tank An outlet of the vacuum unit is connected to a recovery tank that includes an exhaust vent. The combination of forced heated air from the blower and vacuum removal of moisture greatly speeds the carpet drying process. The carpet dryer does not include air compressor capabilities, but merely provides a blower and vacuum unit.

U.S. Pat. No. 5,813,086 to Ueno, et al. discloses a carpet cleaner including a foam generation unit, roller brushes, and a heated air-drying mechanism, and method of use thereof. The carpet cleaner comprises a frame with wheels for mobility. An open cleaning agent tank is attached on frame and contains chemical cleaning agents. A check valve, a pressurizing pump, a foaming space, and a spring valve are connected in sequence to the bottom of the tank via a cleaning agent duct. The cleaning agent duct also houses a metallic mesh and foam cleaning agent nozzle having a foaming sponge. The tip of the foam cleaning agent nozzle opens near the surface of a carpet. A pressurizing pump dispenses liquid-foam cleaning agent from the bottom of cleaning agent tank. The foam cleaning agent undergoes an initial foaming under pressure (with a foam diameter of approximately 5–10 mm) as the pressurized air is transferred to foaming space. When the pressure inside the foaming space exceeds 1–2 kg/cm2, a spring valve opens, resulting in the secondary foaming of a liquid foam cleaning agent. The carpet cleaner does not provide compressed air that can be utilized as a forced air stream by the user; nor does the carpet cleaner disclose a blower function. The carpet cleaner cannot be used for dry vacuum cleaning.

U.S. Pat. No. 6,170,118 to McIntyre, et al. discloses a collection apparatus for use with blower/vacuum units adapted for collecting and storing large amounts of debris. The collection apparatus includes a large drum having an open top, a removable lid, and a disposable and reusable liner. The collection apparatus utilizes a blower/vacuum unit with a variety of intake hoses to easily clean up large volumes of bulky debris while simultaneously depositing the debris into the container. This collection apparatus is appointed for attachment to a blower or vacuum unit, and at best comprises a dry vacuum cleaning unit with large capacity. It cannot function as a wet vacuum cleaner or provide compressed air.

U.S. Pat. No. 6,175,988 to White, et al. discloses a bypass type vacuum cleaner apparatus having particular applications in collecting wet/dry debris from a surface. The tank-type bypass vacuum cleaner apparatus includes a debris collection tank and a recess located in one sidewall of the tank for receiving a debris pickup nozzle or tool. A motor housing and tank cover assembly is releasably secured to tank by latch member. The vacuum cleaner apparatus includes an elongated flexible debris pickup hose member, which is suitably connected to an inlet port of the tank. The carpet bypass vacuum cleaner does not include air compressor capabilities, but merely provides a blower and vacuum unit. It cannot function as a wet-vacuum.

U.S. Pat. No. 6,385,809 to Martin, et al. discloses a gasket-less wet/dry vacuum with switch-able blowing and vacuum modes. The wet/dry vacuum assembly includes a motor cover attached to a lid, which in turn is releaseably attached to a drum by latches. The drum houses any fluid or debris (wet or dry) introduced into the vacuum during normal suction operations. The lid isolates the motor from the drum and prevents the contamination from liquid and debris entering the vacuum during normal operation. A first air passageway defines an air path for the blower port, which is receptive for a hose adapter. A closable door having an open and closed position directs air flow from the main air passageway to either the first or second diverging air passageways to switch between vacuum and blowing modes. The blower port enables the vacuum assembly to be operated as a blower unit. Significantly, the wet/dry vacuum does not include air compressor capabilities, but merely provides blower and vacuum functions.

U.S. Pat. No. 6,530,116 to Berfield, et al. discloses a vacuum cleaner having a muffled detachable blower exhaust unit. The vacuum cleaner includes a tank mounted on wheels. The tank has an open end which is covered by a lid assembly comprising latches to secure the lid to the tank. The vacuum cleaner also includes a detachable blower, which may be detachably secured to the lid assembly by additional latches. The lid also includes a lid passage a lid passage inlet and lid passage outlets. The lid passage is shaped such that air flowing in the lid passage must change direction more than 90 degrees (preferably about 180 degrees) at least once between the lid passage inlet and the lid passage outlets. The lid passage also includes a chamber or plenum into which the air entering through the lid passage inlet initially enters and expands. Disposed into the side wall of the tank is a nozzle, which may be attached to vacuum cleaner implements. Also provided in the side wall of the tank is a drain opening, which is closed by a plug, allowing removal of accumulated fluid when the vacuum cleaner is used in the "wet vac" mode. The vacuum cleaner unit does not include compressor capabilities, but is merely a vacuum cleaner unit having a detachable blower exhaust.

U.S. Pat. No. 6,647,584 to Pileggi discloses a cleaning apparatus using a vapor-mist spray. The cleaning apparatus includes a housing containing an atomizer unit for transforming a cleaning solution into an atomized mist. The apparatus also includes a vacuum unit for removing the cleaning solution from an object surface and a nozzle for delivering the mist to the object surface to be cleaned. The apparatus further includes a dump valve for emptying used liquid materials from the housing. The atomizer unit generally includes a compressor so that the atomization of the cleaning solution is achieved and the cleaning solution disperses into minute particles by introducing a significant amount of air in combination with the cleaning solution. The compressed air is supplied to the holding tank by the compressor, which creates a positive pressure within the tank, thereby forcing the cleaning solution out of the tank into a cleaning solution supply conduit. Thus, the compressor is utilized to both drive the cleaning solution from the holding tank and to atomize the cleaning solution and deliver it to the object surface to be cleaned. The hose includes first and second conduits and a nozzle. The first conduit is in fluid communication with the outlet for discharging the atomized cleaning solution onto the object surface and the second conduit is in fluid communication with the vacuum conduit for vacuuming up the atomized cleaning solution from the object surface. The unit disclosed by the '584 patent thus constitutes a vacuum cleaner having a misted cleaning solution spray. The compressor is used to atomize the cleaning solution, not to produce a supply of compressed air.

U.S. Published Patent Application No. 2004/0098825 to Swift, et al. discloses an improved vacuum cleaner having dual blower jet capability. A conventional, upright vacuum cleaner comprises a lower body assembly that houses the motor, blowers, controls, wheels, floor brush, and various ducts. The upper body assembly of the upright vacuum cleaner contains the refuse chamber, HEPA filter, handle, and hand tool storage capability typically found in conventional upright vacuum cleaners. A conventional floor brush roller is contained within roller vacuum chamber. A duct leads from chamber to an intake port on the vacuum blower in the blower stack assembly, and on to the hand tool vacuum stack. The dual blower, jet-assisted vacuum does not include compressor capabilities, but is merely a vacuum cleaner with dual blower units. Significantly, the dual blower, jet-assisted vacuum does not include an air compressor, wet vacuum, dry vacuum, and blower in a single housing.

There remains a need in the art for a shop vacuum having both dry vacuuming and wet vacuuming functionalities, together with compressed air delivery; all provided in a compact single unit. The compressed air delivery must supply air at a high enough air pressure for paint spraying, operation of pneumatic equipment or sand blasting, as well as deliver air for simple blowing or cleaning purposes. Moisture vacuumed during a wet vacuuming operation should not contaminate air delivery.

SUMMARY OF THE INVENTION

The present invention provides a shop vacuum and air compressor system that is integrated as a single, divisible unit, and provides dry or wet vacuuming capability, as well delivery of compressed air suited for pneumatic tool operation, spray painting or sand blasting as well as air blowing capabilities. The shop vacuum and air compressor system comprises a vacuum section disposed above a compressor section. Each of the sections is capable of independent operation and separation. The air compressor section and vacuum section are powered by independent motors.

The air compressor section has a rotary or piston type compressor driven by a first motor. Compressed air is pumped into a compressed air holding tank. A pressure gage is provided to display the pressure in the air holding tank. A sensor detects the air pressure in the compressed air holding tank and turns the first motor on when the detected air pressure below a value set by the user. The sensor turns off the first motor when the pressure reaches the user preset value. The compressed air holding tank is connected to a compressed air hose through a connection means provided on the side wall of the integrated shop vacuum and air compressor system. The user may attach a number of devices to the distal end of the air hose providing high pressure, compressed air. Alternatively, the compressed air function can be provided for smaller units without use of a holding tank in the conventional way via technology that is readily available.

The vacuum section includes a rotary vacuum pump powered by a second motor. The suction of the vacuum pump is attached to a vacuum debris and moisture collection area. The vacuum debris and moisture collection area has vacuum hose attachment means, which pass through the side wall of the integrated shop vacuum and air compressor system for attachment to a vacuum hose. A filter is provided between the vacuum pump suction and the vacuum tank to prevent any debris from entering the rotary moving parts of the vacuum pump. The vacuum pump exhausts sucked air into the ambient air.

Key features associated with the shop vacuum and compressor system include, in combination, the means set forth below:

1. An integrated unit having a vacuum section on an upper area and a compressor section housed in the lower area of the unit, each of the two units being adapted to be broken down into two fully functional, separate mobile units;
2. The compressor section having a first motor driving a rotary or piston type compressor and a pressure gage and pressure regulator provided to deliver compressed air at selected pressure through an air delivery hose connected to the compressed outlet of the compressor section;
3. The vacuum section comprising a vacuum generating device powered by a second motor drive, the suction end of the vacuum unit being connected to a filter and to a debris and moisture collection area that traps incoming debris or moisture during dry vacuuming or wet vacuuming;
4. The vacuum section optionally being detachable from the integrated shop vacuum and air compressor section, for handling remote air pressure requirements; and
5. The debris and moisture collection area being connected by vacuum connection means to a vacuum hose, the diameter of which decreases as a function of distance from the integral shop vacuum and air compressor system, thereby providing increased suction capacity at the distal end of the vacuum hose suited for collecting debris and moisture.

BRIEF DESCRIPTION OF THE DRAWING

The invention will be more fully understood and further advantages will become apparent when reference is had to the following detailed description of the preferred embodiments of the invention and the accompanying drawing, in which.

DETAILED DESCRIPTION OF THE INVENTION

Figure 1:
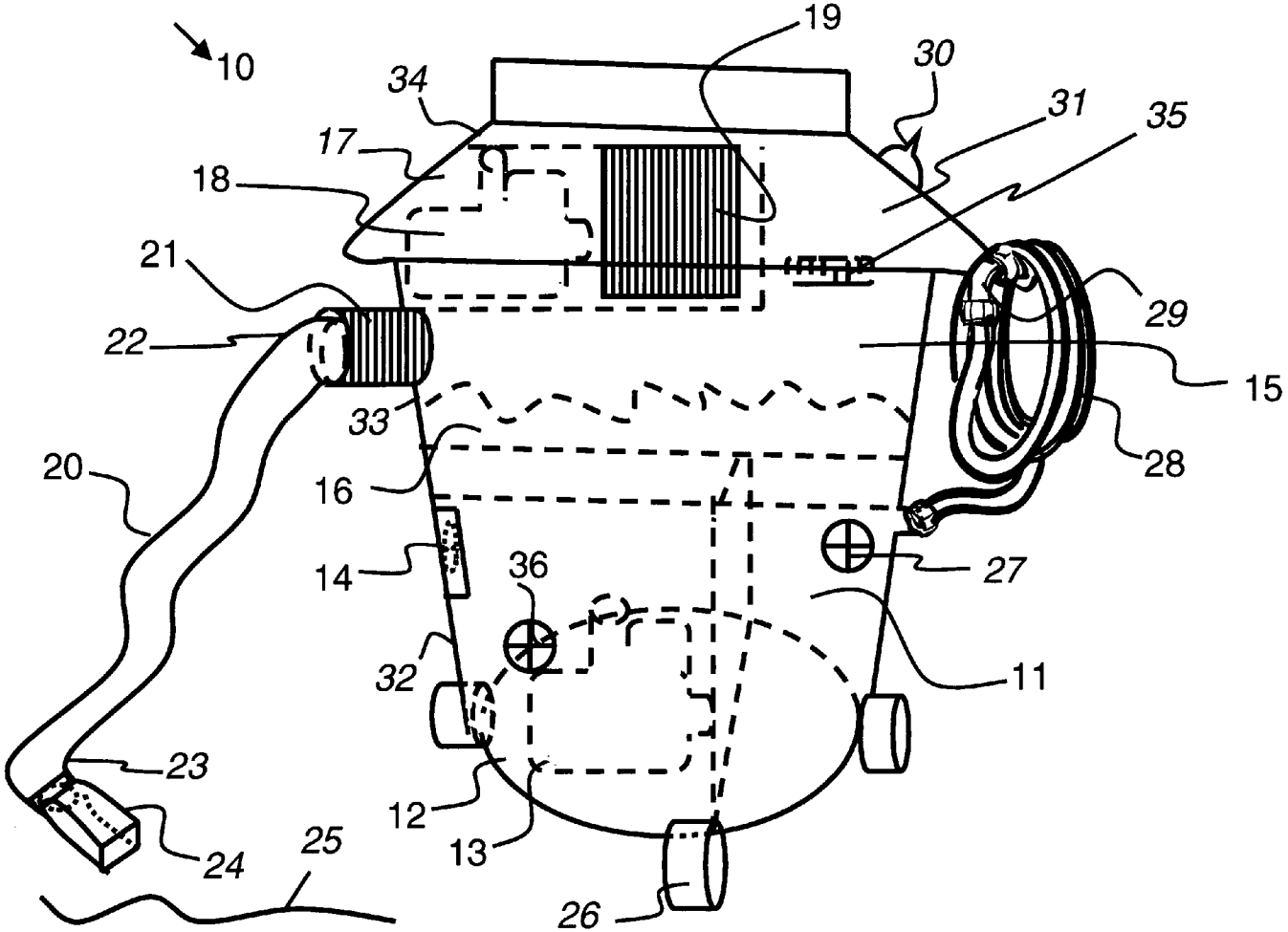
FIG. 1 depicts the schematic view of the integrated shop vacuum and air compressor system.

The present invention provides an integrated shop vacuum and air compressor housed in a single mobile unit. The compartments for the compressor and the vacuum sections are physically separated. The vacuum section is placed above the compressor section and the vacuum section can optionally be detached for bench use. A first motor drives the compressor section and the air pressure is brought to a selected value, at which point the motor is turned off. The compressed air is stored in an air tank, the pressure of which is indicated by a pressure gage. The compressor section may be configured using differently sized components depending on user application. The compressor air motor horsepower ranges from 1/32 HP to 25 HP. The compressed air tank may have a capacity ranging from 0.5 to 25 gallons. The compressed air is connected to a compressor hose which has a length ranging from 0.5 to 50 feet and may have a diameter ranging from 1/32 inch to 3 inches. Alternatively, as previously noted, the compressed air function can be readily provided for smaller units without need of a holding tank using technology that is readily available.

The vacuum section is driven by a second motor drive. The suction side of the vacuum generating unit is provided with a filter to prevent entry of debris or water into the vacuum generating unit. In addition, the debris and water are removed from the air stream by a debris and water collection area, which is placed between the filter and the vacuum hose connecting port on the side wall of the vacuum section. The airflow is reversed in the debris and water collection area, causing separation of water and debris from the air stream. A detachable lid on top of the vacuum section allows the user to access debris collected in the debris collection area of the vacuum section. The vacuum hose will have either a consistent diameter hose or a hose with a larger diameter at the vacuum hose connecting port narrowing down to a smaller diameter at the suction nozzle, thereby increasing the suction velocity, providing effective suction of debris and water. The vacuum section may be configured using differently sized components depending on user application. The vacuum motor horsepower ranges from 1/8 HP to 25 HP.

Generally stated, the integrated shop vacuum and air compressor system is arranged as a single mobile unit, comprising: (i) an air compressor; (ii) an air compressor motor region adapted to house a first motor, for powering the air compressor; (iii) a second motor for powering a shop vacuum, the shop vacuum having a vacuum hose and a debris area for receiving and housing dirt and other debris; and (iv) the vacuum hose having a first end and a second end, the first end of the vacuum hose having a larger diameter than the second end of the vacuum hose. The integrated shop vacuum and air compressor system integrates a compressor unit within a shop vacuum unit, thereby creating a versatile unit having four separate functions, including, dry vacuum, wet vacuum, blower, and compressor functions. The integrated shop vacuum and air compressor system provides a shop vacuum system and an air compressor system in a single, mobile unit that can be readily utilized in a consumer's private garage.

The integrated shop vacuum and air compressor system conveniently integrates a compressor unit into the interstices of a shop vacuum unit, thereby uniquely providing the capability of performing four functions with the use of a single unit. The dry vacuum, wet vacuum, blower, and compressor functions are arranged in a single unit that is space efficient and can be conveniently stored by the consumer. Generally, consumers today must purchase a shop vacuum system and an air compressor system separately, as two discrete units.

Advantageously, the integrated shop vacuum and air compressor system affords the convenience of combining the shop vacuum and air compressor systems in a single, mobile, space saving unit. The integration of a compressor dramatically alters the capabilities of a traditional shop vacuum. Integration of the compressor component results in a highly desirable, versatile capability that is, at present, not available without the amalgamation of separate, cumbersome units. The integrated shop vacuum and air compressor system has particular application with the detailing industry. This industry includes, but is not limited to, the detailing of cars, motorcycles, boats, RV's and campers. The integrated shop vacuum and air compressor system includes additional outlets which, together with its compressor capabilities, significantly increase its versatility. As such, the integrated shop vacuum and air compressor system is particularly appealing to consumers and business owners, ranging from the do-it-yourselfers to large contractors. Conveniently, the integrated shop vacuum and air compressor system comes in various sizes so that the size and affordability can cover a wide range of consumer needs.

FIG. 1 illustrates a schematic view of the integrated shop vacuum and air compressor system, shown generally at 10. The integrated shop vacuum and air compressor system is composed of stainless steel (for high end shops) and injection-molded plastic or "like" materials, for the general marketplace. The integrated shop vacuum and air compressor system comprises a container having a body portion 32 and a top portion 33 with a top lid 34. An air compressor tank 11 is adapted for housing compressed air. Optionally, air compressor tank 11 ranges from 0.5 to 25 gallons, depending on the size of the integrated shop vacuum and air compressor system unit. For smaller units, the compressed air function is readily provided without use of a holding tank via technology that is readily available. A pressure gauge 27 is provided to indicate the pressure of the compressed air within air compressor tank 11. Air hose 28 is received by the air compressor tank 11, and provides delivery of the compressed air through nozzle 29. Air hose 28 may range from 0.5 to 50 feet in length, depending on unit size. An air compressor motor region 12 is adapted for housing a first motor 13 for powering the air compressor tank 11. Air compressor tank 11 is provided with a vent for cooling. Alternatively, cooling is achieved by way of a cooling fan 14. A pressure sensor and switch 36 is optionally integrated into an air pressure on-off switch so that the compressor automatically turns on when lower PSI's are detected, in order to mitigate the risk of compressor burn out. The first motor 13 (i.e. for powering the air compressor) may range from 1/32 to 25 horse power. The air compressor may be rotary or piston type, or the like.

Wheels 26 are provided at the base of the integrated shop vacuum and air compressor system. The wheels 26 are large rubber wheels having omni-directional orientation. Preferably, the integrated shop vacuum and air compressor system has at least three wheels 26. The Integrated shop vacuum and air compressor system is further provided with a second motor 18 housed in vacuum motor region 17 and provided with filter 19. Second motor 18 is adapted for powering the shop vacuum function of the integrated shop vacuum and air compressor system. The second motor 18 ranges from 1/8 to 25 horsepower, depending on unit size.

An electric cord is connected to a power source within the body portion 32 of the integrated shop vacuum and air compressor system for powering the motors 13 and 18. Optionally, the electric cord has a flush wrapping therearound, and may further be retractable. The air hose 28 may have a flush wrapping therearound, and may further be retractable. Alternatively, the integrated shop vacuum and air compressor system has 1 or 2 floor cords depending on unit requirements, and may be configured to run on 110/220 volts. Optionally, the integrated shop vacuum and air compressor system unit has additional 110/220 water resistant outlets integrated in the body portion 32 thereof. The power cord for the compressor unit shall connect to the second motor 18 via internal routing or more likely via an outside cord, allowing it to tap into the previously mentioned power source or a separate external power source. The short cord would allow the unit to be easily broken out, and mounted on a surface (i.e. work bench) or create a rolling compressor capability (less vacuum capability).

The integrated shop vacuum and air compressor system has a vacuum hose 20 connected to the main body of the integrated shop vacuum and air compressor system by way of connection means 21. Vacuum hose 20 may range from 1 to 5 inches in width, depending on the size of the integrated shop vacuum and air compressor system unit. Moreover, the vacuum hose 20 ranges from 6 inches to 30 feet depending on the size of the Integrated shop vacuum and air compressor system unit. Optionally, the vacuum hose 20 is decreased in width as it gets further from the body portion 32. In this embodiment, the vacuum hose 20 has a first end 22 and a second end 23. In one embodiment, the first end 22 of vacuum hose 20 has a larger diameter than second end 23. First end 22 has a diameter ranging from 3–5 inches in diameter, preferably being 3 inches in diameter. Second end 23 has a diameter ranging from 1–3 inches in diameter, preferably being 2 inches in diameter when the first end 22 is 3 inches in diameter. In general, first end 22 is preferably at least 1 inch larger in diameter than second end 23. This difference in diameter provides a greater suction capability at suction head 24. The vacuum hose 20 is connected by connection means 21 to top portion 33 and leads into a debris area 15 adapted for receiving and housing dirt and vacuumed moisture 16 that is sucked up by vacuum hose 20. The debris area 15 may range form 1 pint to 25 gallons, depending on unit size. Top lid 34 is fixedly hinged to top portion 33. Latches 35 are provided for opening top lid 34 so that a user can access debris area 15 for removal of dirt and vacuumed moisture 16 housed therein. Power switch 30 is provided for activating the first and second motors, 13 and 18.

Figure 2:
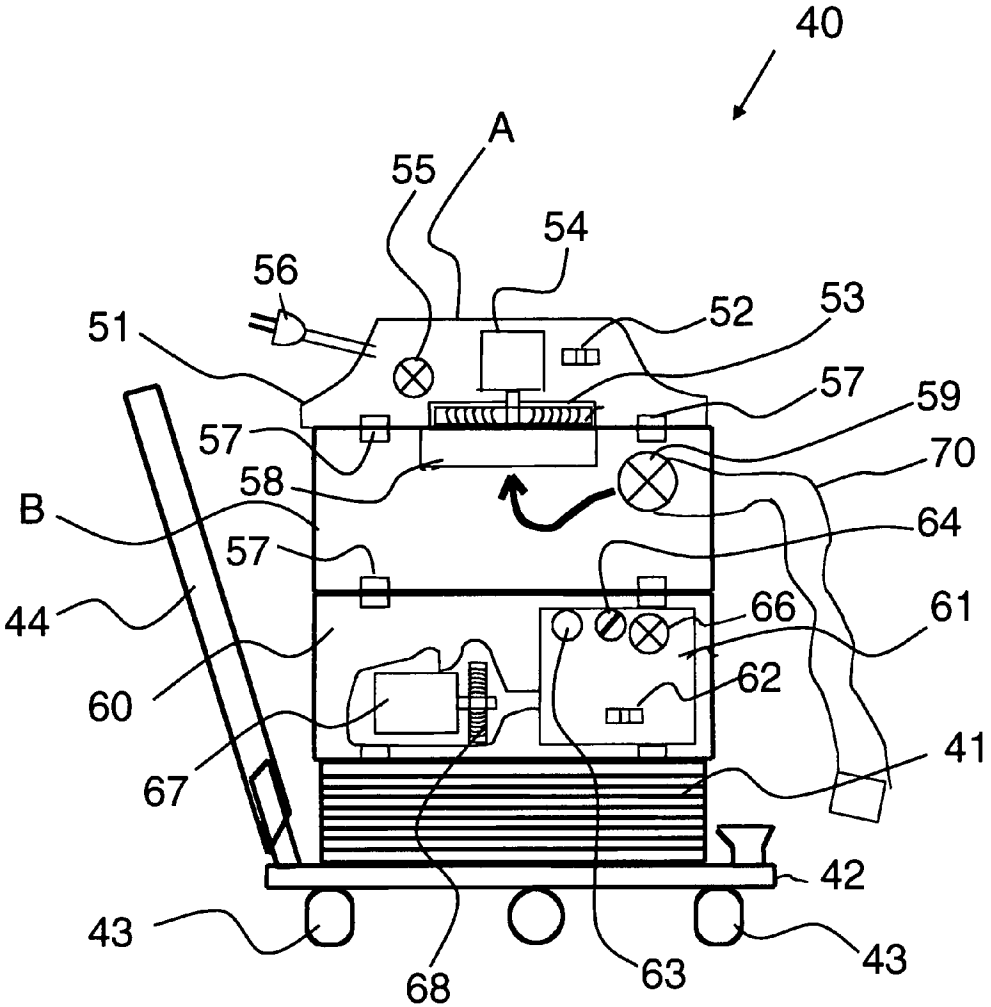
FIG. 2 depicts the schematic view of the alternate embodiment of the integrated shop vacuum and air compressor system.

Referring to FIG. 2, there is shown at 40 an alternate embodiment of the invention, wherein in place of the main body of the integrated shop vacuum and air compressor system, individual components are assembled on a trolley. In this figure, 51 represents the vacuum section and 60 represents the compressor section; the sections 51 and 60 are attached to each other by a set of clips 57. The vacuum section 51 is made up of two disassemblable parts, A and B. The vacuum pump and filter is located in part A, while the debris and moisture collection area is located in part B. The vacuum pump motor is shown at 54 turned on and off by switch 52. The impeller of the vacuum generating unit is shown at 53. The vacuum pump discharges air to the ambient through port 55. Restraining clips hold part A and Part B together with a vacuum seal therebetween. A filter 58 is located at the vacuum inlet port to the vacuum generating unit and filters any debris or moisture brought in by the air stream. A connecting means 59 is provided through the side wall of the vacuum section to which a vacuum hose 70 is attached. Since the airflow changes direction within the debris and moisture collection area B as shown by the arrow, the debris and moisture are removed from the air stream.

The compressor section 60 is located directly below the vacuum section 51, and held thereto by a set of clips 57. The compression section 60 has a compressor motor 67 turned on and off by switch 62. The motor 67 is attached to a centrifugal impeller 68 and the high pressure air generated is stored in a tank 61. Even though a centrifugal compressor is shown here, a piston type compressor may also be used. The high pressure storage tank 61 has pressure gage 63, pressure adjusting means 64 and a high pressure connecting means 66, to which a high pressure air hose is attached.

The compressor section 60, together with the compressor section lid and the vacuum section, is placed on a reel holder pedestal 41. The vacuum hose, air hose and connecting wires are wound on this cylindrical pedestal. The unit is equipped with a fixed wheel arrangement, or a trolley cart having a plurality of removable, omni-directional wheels 43. The trolley can be pulled to another location using a detachable handle 44.

The integrated shop vacuum and air compressor system broadly comprises: an air compressor tank adapted for housing compressed air and being adapted to receive an external compressed air hose; an air compressor motor region adapted for housing a first motor for powering said air compressor; and a second motor for powering a shop vacuum and a blower, said shop vacuum and blower having an external hose and a debris area for receiving and housing wet/dry debris. Optionally, the four components of the integrated shop vacuum and air compressor system can be taken apart from the unit and placed on a work bench or the like. The wheels may be removable, or a dolly may be provided. Potential inclusion of dolly handles, and appropriate wheel assembly may be provided for different handling of full water loads. The compressor section inclusive of lid may have the capability of being bench or wall mounted. Alternatively, the unit may have storage integrated into it or available via attachable included rack. Moreover, the unit may have multiple attachments for the tip of the air hose, giving it air tool capability similar to that of a grease gun, rivet gun, nail gun and the like.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An integrated shop vacuum and air compressor system, comprising:

a. a vacuum section comprising
- (i) vacuum generating means driven by a second motor;
- (ii) a filter appointed to remove debris and moisture from a vacuumed air stream;
- (iii) a debris and moisture collection area;
- (iv) vacuum hose connecting means; and
- (v) a vacuum hose appointed to receive various vacuuming tools;

b. a compressor section comprising;
- (i) compressed air generating means driven by a first motor;
- (ii) an air tank appointed for receiving compressed air produced by said compressed air generating means;
- (iii) compressed air pressure regulating means;
- (iv) high pressure air hose connecting means;
- (v) a high pressure hose appointed to receive various high pressure hardware; and
- (vi) a lid or divider for separating the vacuum section from the compressor section, to thereby create two fully integrated, divisible units, wherein said integrated shop vacuum and air compressor system provides functionalities of a dry vacuum, wet vacuum, high pressure air delivery and air blower in a single unit.

2. An integrated shop vacuum and air compressor system as recited by claim 1, wherein said system is mounted on at least three wheels to provide easy mobility of the system to any desired location.

3. An integrated shop vacuum and air compressor system as recited by claim 1, wherein said vacuum generating means comprises a centrifugal fan.

4. An integrated shop vacuum and air compressor system as recited by claim 1, wherein said compressed air generating means comprises a centrifugal pump.

5. An integrated shop vacuum and air compressor system as recited by claim 1, wherein said compressed air generating means comprises a reciprocal pump.

6. An integrated shop vacuum and air compressor system as recited by claim 1 wherein said vacuum motor has a horse power in the range of ⅛ HP to 25 HP.

7. An integrated shop vacuum and air compressor system as recited by claim 1 wherein said compressor motor has a horse power in the range of 1/32 HP to 25 HP.

8. An integrated shop vacuum and air compressor system recited by claim 1 wherein said compressed air pressure regulating means is appointed to turn on said compressor motor when pressure falls below a preset value, and to turn off said compressor motor when pressure reaches a preset value.

9. An integrated shop vacuum and air compressor system as recited by claim 1 wherein said vacuum hose has a diameter gradually decreasing as a function of distance from a connection point to the integrated shop vacuum and air compressor system towards the vacuum nozzle.

10. An integrated shop vacuum and air compressor system as recited by claim 9 wherein the vacuum hose diameter ranges from 3 to 5 inches at the connection point to the integrated shop vacuum and air compressor system.

11. An integrated shop vacuum and air compressor system as recited by claim 9 wherein the vacuum hose diameter ranges from 1–3 inches at the vacuum nozzle.

12. An integrated shop vacuum and air compressor system as recited by claim 1, wherein said vacuum section and said compressor section fully separate to form two separate, fully functional mobile units.

* * * * *